US008968012B2

(12) United States Patent
Olsson et al.

(10) Patent No.: US 8,968,012 B2
(45) Date of Patent: Mar. 3, 2015

(54) DEVICE CONNECTION CABLE

(75) Inventors: Maj Isabelle Olsson, San Francisco, CA (US); Matthew Wyatt Martin, Ross, CA (US)

(73) Assignee: Google Inc., Mountain View, CA (US)

( * ) Notice: Subject to any disclaimer, the term of this patent is extended or adjusted under 35 U.S.C. 154(b) by 525 days.

(21) Appl. No.: 13/426,896

(22) Filed: Mar. 22, 2012

(65) Prior Publication Data

US 2013/0249777 A1 Sep. 26, 2013

(51) Int. Cl.
*H01R 13/44* (2006.01)

(52) U.S. Cl.
USPC ..... 439/131

(58) Field of Classification Search
CPC ..... H01R 35/04; H01R 13/447
USPC ..... 439/131, 135, 136, 142
See application file for complete search history.

(56) References Cited

U.S. PATENT DOCUMENTS

| | | | | |
|---|---|---|---|---|
| 4,867,551 | A * | 9/1989 | Perera | 351/158 |
| D327,079 | S | 6/1992 | Allen | |
| D334,557 | S | 4/1993 | Hunter et al. | |
| D337,320 | S | 7/1993 | Hunter et al. | |
| D402,651 | S | 12/1998 | Depay et al. | |
| D436,960 | S | 1/2001 | Budd et al. | |
| D446,499 | S | 8/2001 | Andre et al. | |
| D512,985 | S | 12/2005 | Travers et al. | |
| D559,250 | S | 1/2008 | Pombo | |
| D565,082 | S | 3/2008 | McClure et al. | |
| D602,064 | S | 10/2009 | Mitsui et al. | |
| 7,631,968 | B1 | 12/2009 | Dobson et al. | |
| 7,648,236 | B1 | 1/2010 | Dobson | |
| D611,415 | S | 3/2010 | Andre et al. | |
| 7,675,683 | B2 | 3/2010 | Dobson et al. | |
| D623,136 | S | 9/2010 | Andre et al. | |
| D646,316 | S | 10/2011 | Zhao | |
| 2010/0045928 | A1 | 2/2010 | Levy | |
| 2011/0213664 | A1 * | 9/2011 | Osterhout et al. | 705/14.58 |
| 2011/0310318 | A1 * | 12/2011 | Kawagoe | 349/13 |

FOREIGN PATENT DOCUMENTS

WO 2010092904 A1 8/2010

* cited by examiner

*Primary Examiner* — Tulsidas C Patel
*Assistant Examiner* — Phuongchi T Nguyen
(74) *Attorney, Agent, or Firm* — Lerner, David, Littenberg, Krumholz & Mentlik, LLP

(57) ABSTRACT

A connection cable for use with a wearable electronic device includes a first end unit configured to connect with an electronic component and a second end unit. The second end unit has a housing with a connection end configured to connect with a connection feature of an extension arm of the device and a support end spaced apart from the connection end. The housing is configured such that, when the connection end is connected with the connection feature, the support end, the first end of a band of the device, and a nosepiece of the device define at least three points of contact along a plane spaced apart from the surface of the extension arm with the second end unit disposed between the surface of the extension arm and the plane. The cable also includes a cable body extending between the first end unit and the second end unit.

24 Claims, 5 Drawing Sheets

DEVICE CONNECTION CABLE

BACKGROUND

Various forms of cables are used to carry signals to and provide power for portable electronic devices. In many arrangements cables can be used to connect a device to a wall outlet to provide power either for direct operation or to charge an internal batter for later usage. In other arrangements, cables can be used to facilitate connections between portable electronics, such as between smartphones and computers, from one computer to another computer, or from a computer to another peripheral device. Such cables often involve various forms of mating connections, wherein for example, the cable has ends that are configured according to a standard or proprietary configuration, both in shape and with respect to a number and position of electrical connections therein. Such an end can mate with a properly configured port in, for example a computer. The other end of the cable can have the same or a different connection that corresponds with a port in, for example, a portable electronic device.

Many computers and computer peripheral connections are configured to provide power to a portable electronic device, including designated connections that connect, through corresponding wires in the cable to corresponding power pins in a device. In such arrangements, power adapters can also be provided that can connect with a wall outlet and convert the outlet power to that which the power pins and wires are adapted to carry. In such an arrangement, a common cable can provide power and a signal connection with a computer, directly, or a power source, through connection with an adapter.

Docking stations have also been developed that are configured to retain an electronic device in a particular position by cradling a large portion of the device. Such docking stations, however, can often be bulky and heavy, making them difficult to transport. This can be due to their arrangements in which they hold a device completely off of a surface on which the docking stations are configured to rest.

BRIEF SUMMARY

An embodiment of the disclosure relates to a kit. The kit includes an electronic device including a connection surface having a connection port exposed thereon and at least one support surface spaced apart from the connection surface in at least a direction normal thereto. The kit also includes a connection cable including a cable body extending between a first end unit and a second end unit. The first end unit is configured to connect with an electronic component, and the second end unit is configured to connect with the electronic device at the connection port thereof in an assembly of the connection cable and the electronic device. In such an assembly, the at least one support surface of the device is configured to provide first and second points of contact between the assembly and an external supporting surface. The second end unit is further configured to provide a third point of contact between the connection cable and device assembly and such an external supporting surface with the connection surface spaced apart from such an external supporting surface with the second end unit disposed therebetween.

The second end unit can be configured to extend along an axis disposed at an angle of between 80° and 100° with respect to the connection surface of the device when the connection cable is assembled with the electronic device. The second end unit can further include a housing defining a surface thereof that is configured to be spaced apart from the connection surface of the device and disposed relative to the connection surface between parallel therewith and an angle of 15° thereto. Such a surface can be configured to provide the third point of contact.

The electronic component with which first end unit is configured to connect can be a power adapter configured to connect to a wall outlet. Additionally or alternatively, the electronic component with which first end unit is configured to connect can be a computer peripheral port.

The connection surface of the device can be defined on a portion of a device housing, and the support surface can be a corner surface on the device housing that is adjacent the connection surface. The at least one support surface can include a first support surface and a second support surface. Each of the first and second support surfaces can be spaced apart from the connection surface in at least a direction normal thereto.

The electronic device can be a wearable display device that can include a band having a central support portion and extending between first and second ends remote from the central portion. The wearable display device can also include an extension arm attached with the band and supporting an optical element on a side of the center support opposite the first and second ends and a nosepiece attached with the band along the center support and extending away therefrom. In such an example, the connection surface can be defined on a surface of the extension arm disposed away from the band, and the first support surface can be defined on the first end of the band. The second support surface can be defined by a portion of the nosepiece.

Another aspect of the disclosure relates to a connection cable for use with a wearable electronic device. Such an exemplary electronic device can include a band having a central support portion and extending between first and second ends remote from the central portion, a nosepiece attached with the band along the center support and extending away therefrom, and an extension arm attached with the band defining a surface opposite the band with a connection feature exposed thereon and supporting an optical element on a side of the center support opposite the first and second ends. The cable includes a first end unit configured to connect with an electronic component and a second end unit. The second end unit has a housing with a connection end configured to connect with the connection feature of the extension arm and a support end spaced apart from the connection end. The housing is configured such that, when the connection end is connected with the connection feature, the support end, the first end of the band, and the nosepiece define at least three points of contact along a plane spaced apart from the surface of the extension arm with the second end unit disposed between the surface of the extension arm and the plane. The cable also includes a cable body extending between the first end unit and the second end unit.

A first axis can be defined between the connection end and the support end of the housing, and the cable body can extend from the housing along a second axis disposed at an angle between and 100° to the first axis. The second axis can be substantially parallel to the contact surface. A portion of the cable can connect with the housing at a point substantially even with a surface of the support end in a direction along the first axis. In another example, portion of the cable can connect with the housing at a point disposed within 0.2 mm and 1 mm of a surface of the support end in a direction along the first axis.

The cable body can include at least one wire and a jacket surrounding the wire. The cable body can further including a reinforcement insert disposed between at least a point of connection between the cable body and at least one of the first and second end units, and positioned between the wire and the jacket. The reinforcement insert can taper from a first thickness adjacent the one of the first and second end units to a second thickness less than the first thickness at a location remote from the one of the first and second end units. The cable body can extend away from the first end unit along an axis thereof, and the cable body can have a cross-section with a width greater than a thickness thereof by at least a factor of 2 when the cross section is defined by a plane substantially normal to the axis.

Another aspect of the disclosure relates to a kit. The kit includes a device including a band having a central support portion and extending between first and second ends remote from the central portion, an end housing attached with the first end of the band, a nosepiece attached with the band along the center support and extending away therefrom, and an extension arm attached with the band defining a surface opposite the band with a connection feature exposed thereon and supporting an optical element on a side of the center support opposite the first and second ends. The kit also includes a connection cable including a cable body and an end unit. The end unit has a housing with a connection end configured to connect with the connection feature of the extension arm and a support end spaced apart from the connection end. The housing is configured such that, when the connection end is connected with the connection feature, the support end, the end housing, and the nosepiece define at least three points of contact along a plane spaced apart from the surface of the extension arm with the second end unit disposed between the surface of the extension arm and the plane. The plane defined by the nosepiece, the end housing, and the support surface can be within 15° of being parallel to the surface of the extension arm.

The nosepiece can be resiliently deformable such that an orientation of the plane can be related to a deformation of the nosepiece. The nosepiece can include includes first and second pads, and one of the first and second pads can define one of the at least three points along the plane. In a further example, the other of the first and second pads can define a fourth point along the plane. The end housing can be connected with the band by a resiliently flexible connection, and an orientation of the plane can be related to a movement of the end housing permitted by the flexible connection.

The plane can be defined on an external surface on which the wearable device is configured to rest with the surface of the extension arm facing the external surface and spaced apart there from by the end housing of the connection cable.

The support end of the end unit housing can be configured to be substantially parallel to the surface of the extension arm when the connection end is connected with the connection feature.

Side walls of the end unit can be defined between the support end of the end unit housing and the connection end thereof, and the cable body can be connected with the end unit housing at one of the side walls.

The extension arm can be attached with the band on a side of the center support adjacent the end housing, and the end unit of the connection cable can be configured to support the extension arm above an external surface when the end housing and nosepiece are placed in contact with the external surface.

DETAILED DESCRIPTION

Figure 1:
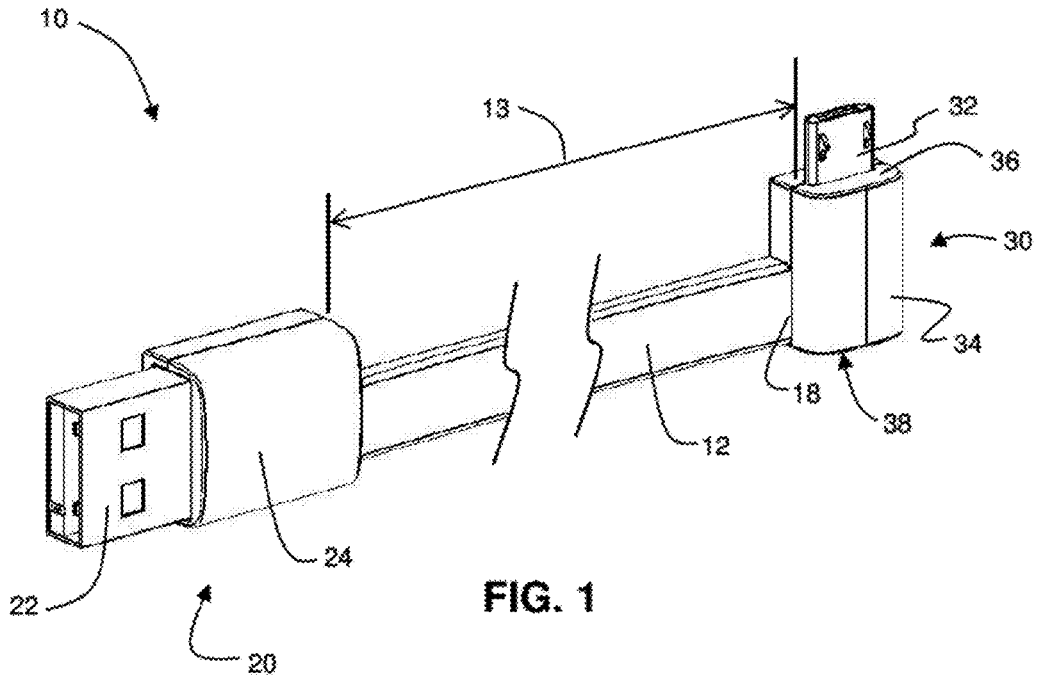
FIG. 1 shows a cable according to an embodiment of the disclosure.
Figure 2:
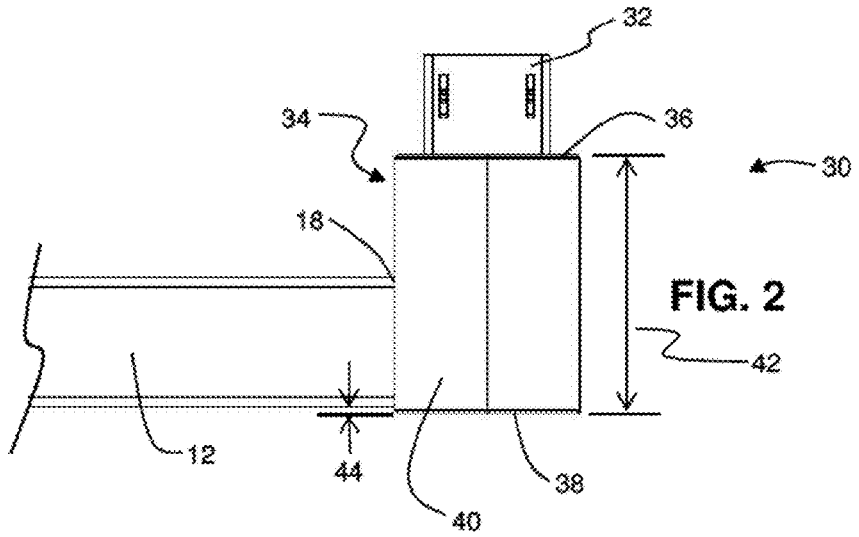
FIG. 2 shows a view of a portion of the cable of FIG. 1.

A cable 10 according to an embodiment of the disclosure is shown in FIG. 1. Cable 10 is shown as an assembly having a cable body 12 with ends 20 and 30 thereof that are configured to provide connections between cable 10 and another electronic device. Cable body 12 can generally be a section of bunched or gathered individual wires (such as wire 14 in FIG. 3) covered in a flexible wire jacket 15 that provides support and additional insulation for the internal wires. Any number of wires can be included in cable body 12, and generally, the number of such wires can correspond to the number of connections between devices that the cable 10 is configured to provide. In an example, cable 10 can be used to connect an electronic device with a computer. Such electronic devices can include, among others, a smartphone, a table computer, an external memory device or the like. In such an example, cable 10 can be used to carry information back and forth between the computer and the device, to provide power to the device, or a combination of both. Cable body 14 can be configured to have any length 13 desired to facilitate connection between electronic devices. In an example, different cables 10 can be provided in varying length, such as 0.5 m, 1.5 m, or 3 m.

Figure 4:
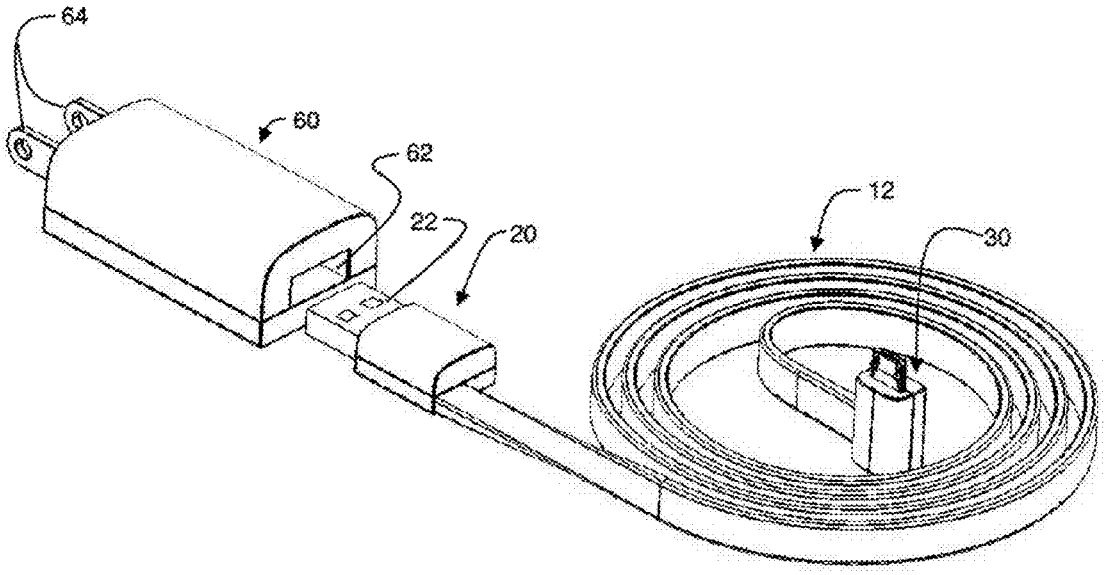
FIG. 4 shows the cable of FIG. 1 with an adapter that can be used therewith.

To allow for connection between electronic devices, as in the above examples, cable 10 is configured with ends 20 and 30 that are structured to connect with mating ports in electronic devices by insertion thereinto. In the example of FIG. 1, first end 20 includes a connection 22 that is in the form of a standard USB-A style connection. Connection 22 is attached to and extends from a housing 24 that covers the joints between various features of connection 22 and the wires 18 that extend through cable body. Housing 24 can also provide a rigid feature that a user can grasp while inserting or removing connection 22 into or out of a mating USB port. In other examples, connection 22 can be configured to connect with a Firewire™ port, a Thunderbolt™ port, or any other standardized, proprietary, or specialized connection port in a computer or other electronic device. In the example shown in FIG. 4, first end 20 can have a USB-A style connection structure that can, in addition to connecting with a USB port of a computer, can connect with a USB power connection 62 in, for example a power adapter 60 that can include prongs 64 configured to connect with a wall outlet. This can allow the same cable 10 to connect with a computer, for charging a device or data transfer between a device and a computer, or to adapter 60 to charge a device. Other connections can be used to connect with an adapter, including other computer peripheral connections configured for delivering power, a barrel-type connection, or other proprietary or specialized connections.

As also shown in FIG. 1, second end 30 also includes a connection structure 32 and a housing 34 that conceals any internal joints between conductive features of the connection structure 32 and the wires 14 internal to the cable 10. Connection structure 32 can be arranged to connect with an electronic device, which can include by a connection structure 32 that is similar to connection structure 22 of first end 20. In other embodiments, such as that shown in FIG. 1, the connection structure 32 of second end 30 can be generally smaller than that of first end 20 to connect with the generally smaller connection ports of portable electronic devices, such as smartphones, head-mounted displays, or the like. In an embodiment, connection structure 32 can be a USB-B or a USB-mini size connection structure, a 4-pin Firewire™ connection structure or the like. In a further embodiment, connection structure 32 can be a specialized or proprietary structure configured to connect with a mating port in a device. Such structures can be used to provide variations of cable 10 that can have a similar connection structure 32 on second end 30 but different connection structures 22 on first end 20.

Second end 30 is further configured such that connection structure 32 extends from a connection end 36 of housing 34 and a support surface 38 disposed at an opposite end of housing 34 from connection end 36. Sidewalls 40 of housing 34 extend between connection end 36 and support surface 38 thereof. Support surface 38 can be spaced apart from connection end 36 to give second end a height 42 and can be angled with respect thereto to give second end 30 the ability to provide a support for an electronic device with which it is connected, as described below. Additionally, cable body 12 can be connected with second end 30 at a sidewall 40 thereof and can extend generally normal to an axis of second end 30 that can be defined by an insertion direction of the connection structure 32 with a mating port or by a direction normal to the connection end 36 of second end 30.

Figure 3:
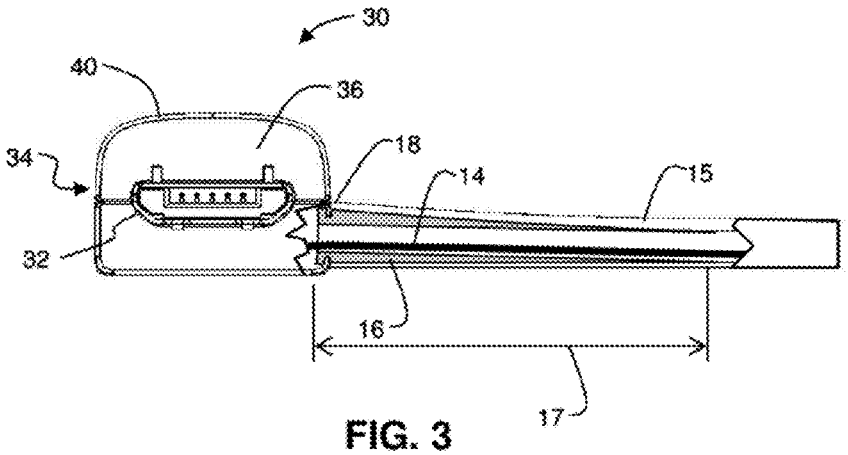
FIG. 3 shows a partial cutaway view thereof.

As shown in FIG. 3, cable body 12 can include a reinforcing insert near its attachment with either or both of the first 20 and second 30 ends. The reinforcing structure can provide additional bulk or structure to the cable body 12 in the area of second housing 30 to help second housing maintain an upright position on a surface when carrying out a supporting function, as described below. Such a reinforcing insert can also provide additional support for cable at an area that is prone to wear from bending about such a housing during winding or use thereof. In one embodiment, insert 16 can be positioned inside jacket 15 surrounding wire 18 (or a group of bundled wires) on four sides thereof. Insert 16 can be of a more rigid material than jacket 15, which is typically of a flexible rubber material. In an example, insert 16 can be of a flexible plastic material such as polyethylene, polystyrene, polypropylene, or the like. In other examples, insert 16 can be of a rubber or TPE that is comparatively more rigid than that of jacket 15, or insert 16 can be of the same material as jacket 15, providing reinforcement by the added total thickness by the presence of insert 16 or by being of a thicker construction that jacket 15.

In an example, cable body 12 can be cut from a length of cable on a roll or other supply and then an insert 16 can be pressed into place beneath jacket 15. Insert 16 can be tapered to a wedge shape to facilitate such an assembly. Such a tapered structure can also provide reinforcement that is strongest at the attachment 18 with housing 34 (or 24) and gradually lessens along the length 17 of insert 16 to the end of the insert 16 adjacent to which, the flexibility thereof can be similar to that of the cable body 12 with no reinforcement.

Figure 5A:
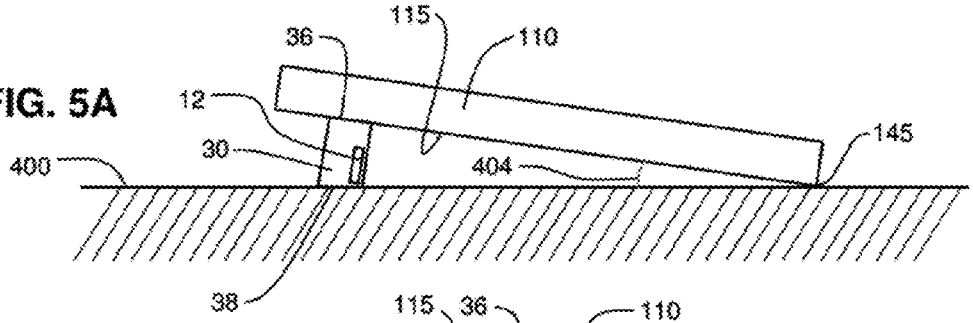
FIGS. 5A and 5B shows an arrangement where a cable according to an embodiment of the disclosure is used with an electronic device.
Figure 5B:
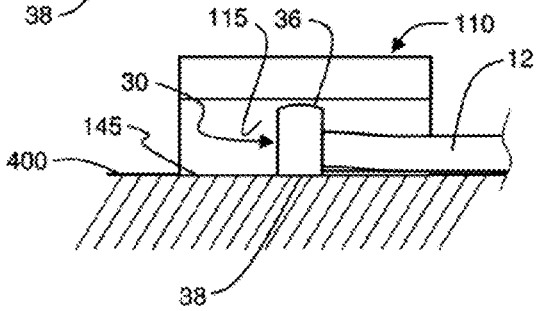

As mentioned above, second end 30 of the cable 10 can be configured to provide a supporting function when connected with an appropriately-configured electronic device. In the example shown in FIGS. 5A and 5B, an electronic device 110 can be provided with a connection port available for connection with connection structure 32 on a surface 115, thereof. In an embodiment, such a surface 115 can be a bottom surface of the device that is intended or otherwise configured to face a surface upon which the device 110 is placed during use, rest, or storage. In an example, device 110 can be a smartphone with a screen thereof facing away from surface 115 such that when second end 30 of cable 10 is assembled with the connection port, surface 115 can be propped-up with the screen angled to face a user thereof, as shown in FIGS. 5A and 5B. In such an arrangement, an edge surface 145 of the device 110 adjacent surface 115 can remain in contact with the surface 400 on which device 110 is resting to form at least two points of contact therewith. In such an arrangement, support surface 38 can provide a third point of contact with the surface 400 so that device 110 can stably rest on surface 400. With second end 30 held in place beneath surface 115 by connection 32 and a mating connection feature of device 115.

In the propped-up arrangement shown in FIGS. 5A and 5B, support surface 34 can be angled with respect to connection end at an angle that corresponds with the desired angle 404 for surface 115 of device 110 with respect to surface 400. As such, support surface 38 can be described as being angled with respect to the axis of the housing 32 at an angle complementary to the angle 404 of device 110 on surface 400. Additionally, height 42 of second end 30 can be configured to give device 115 the desired angle with respect to surface 400, given the length of device 110 and the distance from edge surface 145 the second end 30 is connected with device 110.

Figure 6:
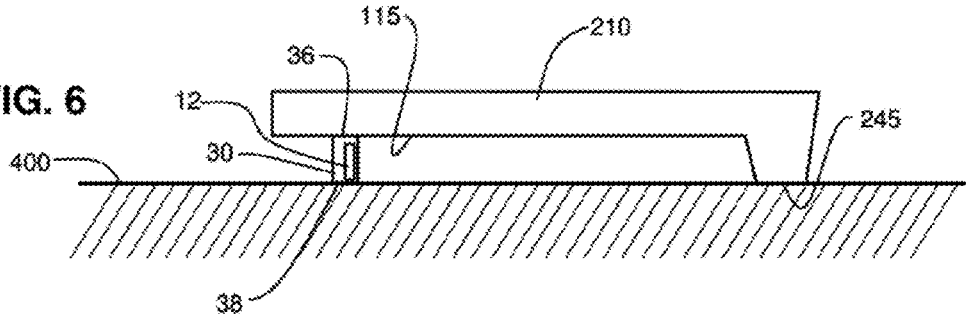
FIG. 6 another arrangement where a cable according to an embodiment of the disclosure is used with an electronic device.

In another example shown in FIG. 6, device 210 can include a first surface 215 on which a mating connection port for assembly with connection structure 34 is positioned. A second surface 245 can also be included that is spaced away from surface 215 such as in the direction from which the housing 32 of second end 30 is configured to extend. In such an arrangement, device can be configured such that, when second end 30 is not connected therewith, surface 215 is angled with respect to a surface 400 on which device 210 is resting. When second end 30 of cable 10 is connected therewith, surface 215 can be supported above surface 400 with support surface 38 providing a point of contact with surface 400 by attachment with device 215. Further, second surface 245 can provide at least two additional points of contact with surface 400. In such a configuration, the height 42 of second end 30 can be configured to substantially match the distance away from surface 215 that second surface 245 is positioned.

In the examples shown in FIGS. 5A, 5B, and 6, devices 110 and 210 can represent smartphones, tablet computers, laptop computers, keyboards or the like, or can generally schematically represent various forms of head-wearable display devices. The supporting functionality of second end 30 can be used to provide optional positioning of input features, such as touchscreens, keyboards, or the like or can be configured to provide optimized resting or storage positions thereof on surface 400.

When second end 30 of cable 10 is configured to provide such a supporting function, it can be advantageous to position cable body 12 such that it attaches with a sidewall 40 of housing 34 at a position adjacent support surface 38. In an embodiment, a portion of cable body 12 can be substantially flush with support surface 38. In another example, cable body 12 can be positioned such that a portion thereof is at a distance 44 that is within 2 mm of support surface 38. In a further example, a portion of cable body 12 can be positioned such that distance is less than about 1 mm or in other embodiments less than about 0.5 mm. Such an arrangement can allow for cable to rest on surface 400 near the connection 18 thereof with housing 32, which can reduce instability of housing 32 due to the weight of cable body 12.

Figure 7:
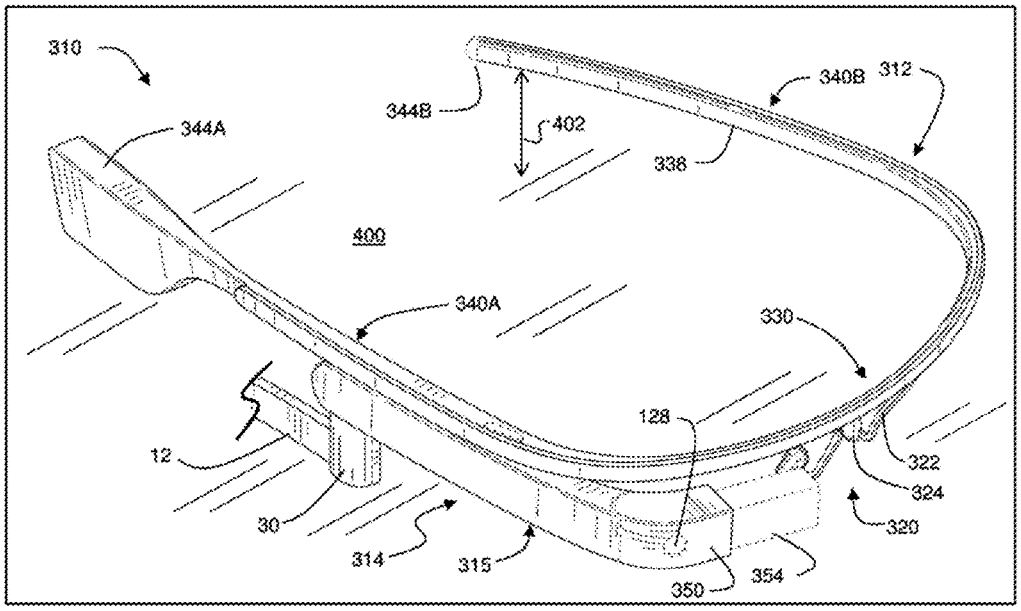
FIG. 7 shows a head wearable display device in an assembly with the cable of FIG. 1.
Figure 8:
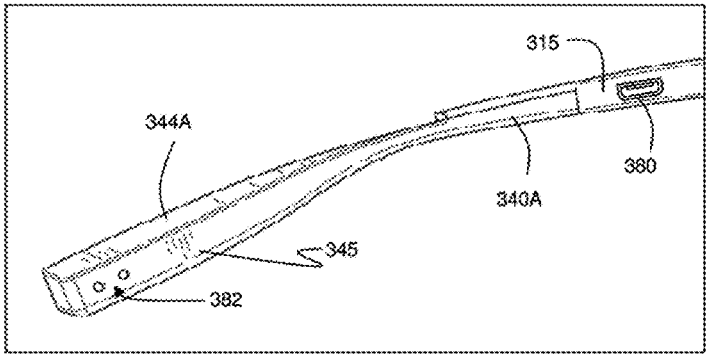
FIG. 8 shows a detail view of the head wearable display device shown in FIG. 7.
Figure 9:
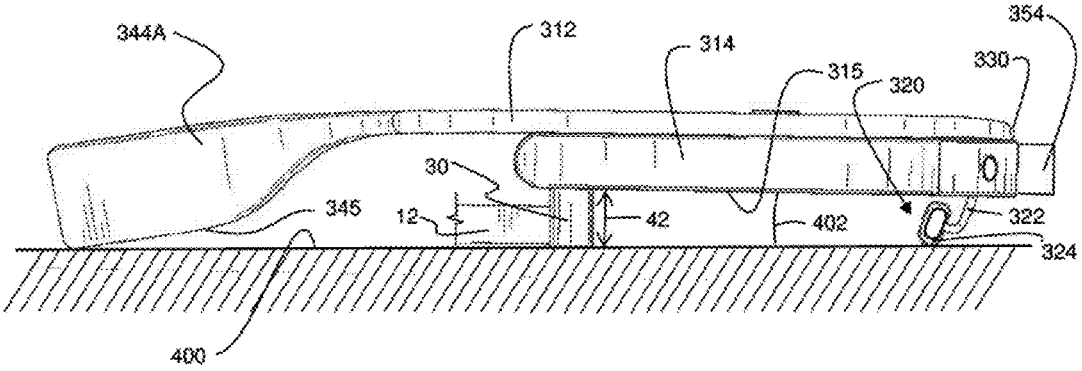
FIG. 9 shows an alternate view of the assembly of FIG. 7.

An example of a head-wearable display device 310 that can be used with cable 10 is shown in FIGS. 7-9. Such a device 310 can include a band 312 that provides a desired fit of device 310 on a user's head. Device 310 can further include an extension arm 314 that extends from a portion of band 312 to a free end 316 thereof that includes a display element 354. Extension arm 314 can be configured such that, when device 310 is worn by a user, display 354 mounted on extension arm 314 can be positioned adjacent the user's eye, within the user's line of sight of at least that eye, for making an image presented thereon viewable by the user.

Band 312 is shown in FIG. 7 as including a central portion 330 with side arms 340A,340B extending away from opposite sides of the central portion 330. Central portion 330 can include a nosepiece 320 configured to rest on the nose of a wearer with the central portion 330 providing a central support for side arms 340A,340B, which can extend unitarily therefrom including a bend or curve therebetween. Accordingly, device 310 can be worn on a user's head such that nosepiece 320 can rest on the user's nose with side arms 340A,340B extending over respective temples of the user and over adjacent ears. The device 320 can be configured such that display element 354 is appropriately positioned in view of one of the user's eyes.

Side arms 340A,340B can be configured to contact the head of the user along respective temples or in the area of respective ears of the user. Side arms 340A,340B include respective free ends 344 opposite central portion 330. Free ends 344 can be positioned to be located near the ear of a user when wearing device 310. As shown in FIG. 7 the center portion 330 and side arms 340A,340B may generally have a "U" shape. In this example, the U shape is asymmetric. The asymmetry is due, in part, to the different configurations of the free ends 344A,344B of the side arms 340A,340B. As shown, free end 344A may be enlarged to house circuitry and/or a power supply (e.g., removable or rechargeable battery) for the device 310. The configurations of the two free ends may be switched so that free end 344B houses circuitry and/or power supply equipment.

Extension arm 314 can include a first portion 376 that extends downward from band 312 at a first portion 376 that can be shaped to also extend along a length of band, such as along side arm 340A. First portion 376 is further shaped to extend away from band 312 to an elbow portion 350 connected with first portion 376 by a joint 356. Elbow portion 350 can support display 354 at an angle relative to arm 376 that can be adjusted by rotation of elbow portion 350 about joint 356.

Enlarged free end 344A can also include one or more connection contacts 382 that can be used to connect device 310 to a power source to recharge a battery without removal thereof. Further device 310 can include a connection port 380 that can be used to connect device 310 to small end 30 of cable 10 by being adapted to receive connection structure 32 therein. As such, cable 10 can be used to connect device 310 with another component or structure, as discussed above. Other features, structures, and functionality of device 310 can be similar to those of the head-wearable display device described in the co-pending U.S. patent application Ser. No. 13/426,033, the entire disclosure of which is incorporated by reference herein.

As shown in FIG. 7, while device is adapted to be worn on the head of a user, as described above, it may not be adapted to evenly or stably rest on a surface, such as surface 400, while not being worn by a user. As shown, both nosepiece 320 and enlarged free end 344A are configured to extend below band 312 when device 310 is resting right-side-up (as shown in FIG. 7) on surface 400. Extension arm 314 also extends below band 312, but by a lesser distance than either enlarged free end 344A or nosepiece 320. Therefore, when device 310 is positioned on surface 400 with a portion of the lower surface 245 of enlarged free end 344A and a surface of at least one of the pads 324 also contacting surface 400, device would tend to tip downward in the direction of extension arm 314 until extension arm 314 also touched surface 400. Such a resting configuration could be undesirable from an aesthetic point of view, and could also give a feeling of instability to a user or could lead to inadvertent damage to device 310 by accidental contact with free end 344B, which would, accordingly, be positioned at a height 402 above surface 400 greater than the other portions of device 310.

By positioning port 380 on the lower surface 315 of extension arm 314, second end 30 of cable 10 can be connected with device 310 in a position such that second end 30 can provide a supporting function for device 310. As shown in FIGS. 7 and 9, second end 30 can connect to port 380 by connection structure 32 such that it extends away from surface 315 to position supporting surface 38 away from surface 315. Accordingly, when the device 310 is then positioned right-side-up on surface 400, second end 30 of cable 10 is secured in a position between surface 315 and surface 400 with device 310 supported thereby. Such an arrangement can prevent undesirable tipping of device 310 under unsupported weight of extension arm 314.

In an embodiment, second end 30 of cable 10 can be configured such that surface 315 is substantially parallel with surface 400 when device 310 is resting thereon with extension arm 314 supported by second end 30. In other embodiments, the height relationship among supporting surface 38, nosepiece 320 and the lower surface 245 of enlarged free end 344A may be such that surface 315 is not exactly parallel with surface 400. This can be due to the relative sizes of these features or various arrangements in which they are positioned. In an example, the arms 322 of nosepiece 320 that support pads 324 can be flexible to allow a user to configure a distance between pads 324 to position display 354 in a comfortable viewing position with respect to the user's eye. This can affect the distance below central portion 330 of band 312 to which pads 324 extend. Further, enlarged free end 344A can be flexibly attached to the remaining portion of band 312. Such a flexible attachment can either be configured to provide user-adjustability or a comfortable retention force against the user's head. In an example where the flexible attachment provides adjustment, the variation in position of the enlarged free end 344A can lead to differences in how second end 30 supports device 310. Further in an example where such a connection is generally resiliently flexible, the band 312 can bend at the connection with enlarged free end 344A under the weight of device 310 when positioned on a surface 400.

In an embodiment, the height 42 of second end 30 can be configured to provide support through a desired range of adjustment or flexation of nosepiece 320 and enlarged free end 344A such that, when second end 30 is connected with device 310, surface 315 is positioned within about 10° of being parallel with surface 400 or, in another embodiment within about 5° of parallel with surface 400. In an example configuration of device 310, nosepiece is configured to adjustably position pads below band 312 in a range between about 20 mm and 22 mm. Enlarged free end 344A is configured to extend below band 312 to a point that can be between about 25 mm, and surface 315 can be positioned at about 10 mm below band 312. A corresponding housing 32 of second end 30 can have a height 42 between about 10 mm and 20 mm to achieve a supporting configuration as described above. In a further example, height 42 can be between about 12 and 16 mm and in another example about 14 mm. The height 42 of housing 32 can be adjusted proportionately with changes in the ranges of dimensions for the other features of device 310 to provide a similar supporting functionality. In one example, the height 42 of housing 32 can be configured such that the height 402 of free end 344B above surface 400 is between 90% and 110% of the distance below band 312 to which free end 344A extends.

In an example, support surface 38 can be generally parallel to connection end 34 of second end 30. Such an arrangement can allow support surface 38 to rest evenly on surface 400 when positioned at a similar distance below band 312 as enlarged free end 344A and at least one of the pads 324. In variations of device 310, such as by user adjustment of the features thereof, support surface 38 can be uneven on surface 400 such that only a portion (including an edge or corner, for example) can contact surface 400 to provide a desired supporting characteristic. Further, in some embodiments, such as by user adjustment or the like, either or both of the pads 324 can provide points of contact with surface 400.

Although the description herein has been made with reference to particular embodiments, it is to be understood that these embodiments are merely illustrative of the principles and applications of the present disclosure. It is therefore to be understood that numerous modifications may be made to the illustrative embodiments and that other arrangements may be devised without departing from the spirit and scope of the present disclosure as defined by the appended claims.

The invention claimed is:

1. A portable electric device kit, comprising: an electronic device including a connection surface having a connection port exposed thereon and at least one support surface spaced apart from the connection surface in at least a direction normal thereto; and a connection cable including a cable body extending between a first end unit and a second end unit, the first end unit being configured to connect with an electronic component, the second end unit configured to connect with the electronic device at the connection port thereof in an assembly of the connection cable and the electronic device;

wherein the at least one support surface of the device is configured to provide first and second points of contact between the assembly and an external supporting surface, and wherein the second end unit is further configured to provide a third point of contact between the connection cable and device assembly and such an external supporting surface with the connection surface spaced apart from such an external supporting surface with the second end unit disposed therebetween;

wherein the at least one support surface includes a first support surface and a second support surface, each of the first and second support surfaces being spaced apart from the connection surface in at least a direction normal thereto.

2. The kit of claim 1, wherein the electronic component with which first end unit is configured to connect is a power adapter configured to connect to a wall outlet.

3. The kit of claim 1, wherein the electronic component with which first end unit is configured to connect is a computer peripheral port.

4. The kit of claim 1, wherein the connection surface is defined on a portion of a device housing, and wherein the support surface is a corner surface on the device housing that is adjacent the connection surface.

5. The kit of claim 1, wherein the electronic device is a wearable display device, including:

a band having a central support portion and extending between first and second ends remote from the central portion;

an extension arm attached with the band and supporting an optical element on a side of the center support opposite the first and second ends; and a nosepiece attached with the band along the center support and extending away therefrom;

wherein the connection surface is defined on a surface of the extension arm disposed away from the band, wherein the first support surface is defined on the first end of the band, and wherein the second support surface is defined by a portion of the nosepiece.

6. The kit of claim 1, wherein the second end unit is configured to extend along an axis disposed at an angle of between 80° and 100° with respect to the connection surface of the device when the connection cable is assembled with the electronic device.

7. The kit of claim 6, wherein the second end unit includes a housing defining a surface thereof that is configured to be spaced apart from the connection surface and disposed relative to the connection surface between parallel therewith and an angle of 15° thereto, and wherein the surface is configured to provide the third point of contact.

8. A connection cable device for use with a wearable electronic device including a band having a central support portion and extending between first and second ends remote from the central portion, a nosepiece attached with the band along the center support and extending away therefrom, and an extension arm attached with the band defining a surface opposite the band with a connection feature exposed thereon and supporting an optical element on a side of the center support opposite the first and second ends, the cable comprising:

a first end unit configured to connect with an electronic component;

a second end unit having a housing with a connection end configured to connect with the connection feature of the extension arm and a support end spaced apart from the connection end, the housing being configured such that, when the connection end is connected with the connection feature, the support end, the first end of the band, and the nosepiece define at least three points of contact along a plane spaced apart from the surface of the extension arm with the second end unit disposed between the surface of the extension arm and the plane; and a cable body extending between the first end unit and the second end unit;

wherein a first axis is defined between the connection end and the support end of the housing, and wherein the cable body extends from the housing along a second axis disposed at an angle between 80° and 100° to the first axis.

9. The cable of claim 8, wherein the second axis is substantially parallel to the contact surface.

10. The cable of claim 8, wherein a portion of the cable connects with the housing at a point substantially even with the surface of the support end in a direction along the first axis.

11. The cable of claim 8, wherein a portion of the cable connects with the housing at a point disposed within 0.2 mm and 1 mm of a surface of the support end in a direction along the first axis.

12. The cable of claim 8, wherein the cable body extends away from the first end unit along an axis thereof, and wherein the cable body has a cross-section having a width greater than a thickness thereof by at least a factor of 2 when the cross section is defined by a plane substantially normal to the axis.

13. The cable of claim 8, wherein the cable body includes at least one wire and a jacket surrounding the wire, the cable body further including a reinforcement insert disposed between at least a point of connection between the cable body and at least one of the first and second end units, the reinforcement insert being positioned between the wire and the jacket.

14. The cable of claim 13, wherein the reinforcement insert tapers from a first thickness adjacent the one of the first and second end units to a second thickness less than the first thickness at a location remote from the one of the first and second end units.

15. A portable electric device kit, comprising a device including a band having a central support portion and extending between first and second ends remote from the central portion, an end housing attached with the first end of the band, a nosepiece attached with the band along the center support and extending away therefrom, and an extension arm attached with the band defining a surface opposite the band with a connection feature exposed thereon and supporting an optical element on a side of the center support opposite the first and second ends;

a connection cable including a cable body and an end unit, the end unit having a housing with a connection end configured to connect with the connection feature of the extension arm and a support end spaced apart from the connection end, the housing being configured such that, when the connection end is connected with the connection feature, the support end, the end housing, and the nosepiece define at least three points of contact along a plane spaced apart from the surface of the extension arm with the second end unit disposed between the surface of the extension arm and the plane.

16. The kit of claim 15, wherein the plane is defined on an external surface on which the wearable device is configured to rest with the surface of the extension arm facing the external surface and spaced apart there from by the end housing of the connection cable.

17. The kit of claim 15, wherein the support end of the end unit housing is configured to be substantially parallel to the surface of the extension arm when the connection end is connected with the connection feature.

18. The kit of claim 15, wherein side walls of the end unit housing are defined between the support end of the end unit housing and the connection end thereof, and wherein the cable body is connected with the end unit housing at one of the side walls.

19. The kit of claim 15, wherein the extension arm is attached with the band on a side of the center support adjacent the end housing, and wherein the end housing of the connection cable is configured to support the extension arm above an external surface when the end housing and nosepiece are placed in contact with the external surface.

20. The kit of claim 15, wherein the nosepiece includes first and second pads, and wherein one of the first and second pads defines one of the at least three points along the plane.

21. The kit of claim 20, wherein the other of the first and second pads defines a fourth point along the plane.

22. The kit of claim 15, wherein the plane defined by the nosepiece, the end unit housing, and the support end is within 15° of being parallel to the surface of the extension arm.

23. The kit of claim 22, wherein the nosepiece is resiliently deformable such that an orientation of the plane is related to a deformation of the nosepiece.

24. The kit of claim 22, wherein the end housing is connected with the band by a resiliently flexible connection, and wherein an orientation of the plane is related to a movement of the end housing permitted by the flexible connection.

* * * * *